US005427844A

United States Patent [19]

Murai et al.

[11] Patent Number: 5,427,844

[45] Date of Patent: Jun. 27, 1995

[54] ARTICLES OF NATURAL CELLULOSE FIBERS WITH IMPROVED DEODORANT PROPERTIES AND PROCESS FOR PRODUCING SAME

[75] Inventors: Koichi Murai, deceased, late of Nagaokakyo, by Mutsuko Murai, Kyoko Murai, heirs; by Kei Takeda, heir, Uji; by Kumi Fujimoto, heir, Nagaokakyo; by Rumi Emori, heir, Sendai; Hidekazu Nakagawa, Shiga; Motohiko Otani, Uji; Yoshiaki Sakai, Kashihara; Hiroyuki Miura, Konan; Yutaka Tsujimoto, Nishinomiya; Kango Fujitani, Uji, all of Japan

[73] Assignees: New Japan Chemical Co., Ltd.; Shikibo Ltd., both of Japan

[21] Appl. No.: 166,980

[22] Filed: Dec. 15, 1993

Related U.S. Application Data

[63] Continuation-in-part of Ser. No. 895,662, Jun. 9, 1992, abandoned.

[30] Foreign Application Priority Data

Jun. 12, 1991 [JP] Japan ..... 3-139902

[51] Int. Cl.[6] ..... B32B 7/00

[52] U.S. Cl. ..... 428/245; 427/341; 427/342; 427/354; 427/370; 427/392; 427/439; 428/248; 428/253; 428/254; 428/264; 428/289; 428/375; 428/379; 428/389; 428/905

[58] Field of Search ..... 427/341, 342, 354, 370, 427/392, 439; 428/245, 248, 253, 254, 264, 289, 375, 379, 389, 905

[56] References Cited

U.S. PATENT DOCUMENTS

| | | | |
|---|---|---|---|
| 1,990,292 | 2/1935 | Leatherman . | |
| 2,097,589 | 11/1937 | Dreyfus . | |
| 2,289,282 | 7/1942 | Brodersen et al. . | |
| 2,525,049 | 10/1950 | Kerr | 536/101 |
| 2,983,722 | 5/1961 | Horowitz et al. | 536/101 |
| 3,053,607 | 9/1962 | Gulledge | 536/101 |
| 4,506,684 | 3/1985 | Kentsis | 131/359 |
| 4,757,099 | 7/1988 | Hoshiro et al. | 523/102 |
| 5,049,159 | 9/1991 | Yamaji et al. | 8/125 |

FOREIGN PATENT DOCUMENTS

| | | |
|---|---|---|
| 542775 | 1/1932 | Germany . |
| 337813 | 11/1930 | United Kingdom . |

*Primary Examiner*—James J. Bell
*Attorney, Agent, or Firm*—Larson and Taylor

[57] ABSTRACT

A yarn, cloth, woven fabric, knitted fabric or nonwoven fabric composed of natural cellulose fibers, each fiber having incorporated therein a water-insoluble inorganic metal compound, and each fiber having at least one cured polycarboxylic acid combined therewith, said polycarboxylic acid being one selected from the group consisting of polycarboxylic acids and partial salts thereof, and a process for preparing the same.

28 Claims, No Drawings

ARTICLES OF NATURAL CELLULOSE FIBERS WITH IMPROVED DEODORANT PROPERTIES AND PROCESS FOR PRODUCING SAME

This application is a continuation-in-part of application Ser. No. 07/895,662, filed Jun. 9, 1992, now abandoned.

The present invention relates to articles of natural cellulose fibers having improved deodorant properties and a process for producing the same.

The term "article of natural cellulose fibers" used herein refers to a yarn, cloth, woven fabric, knitted fabric or nonwoven fabric composed of natural cellulose fibers.

Natural cellulose fibers treated with an inorganic metal compound are known (U.S. Pat. Nos. 3,053,607; 5,049,159; 2,289,282; 2,097,589; 1,990,292, British Patent No. 337,813 and German Patent No. 542,775). The present inventors investigated these natural cellulose fibers and found that the fibers can effectively deodorize acids but can not deodorized ammonia, namely produce unsatisfactory effects. Further, such fibers when washed repeatedly can not retain the function of deodorizing acids for a prolonged period of time.

Also known are natural cellulose fibers prepared by impregnating the fibers with at least one of polycarboxylic acids and partial salts thereof, followed by heat treatment (U.S. Pat. No. 3,526,048). However, the technique disclosed in U.S. Pat. No. 3,526,048 intends to improve the property of preventing wrinkles, but not the deodorant properties.

It is also known that synthetic fibers prepared by kneading the solids of a basic zinc compound and a polycarboxylic acid with a thermoplastic resin and making the mixture into synthetic fibers can deodorize ammonia and hydrogen sulfide on absorption (U.S. Pat. No. 4,757,099). When solids can be kneaded with a thermoplastic resin as in the preparation of synthetic fibers, the basic zinc compound and polycarboxylic acid, because of solids,are not contacted with each other so that they are not inactivated by neutralization reaction. However, in the case of natural cellulose fibers, kneading can not be done in any manner unlike synthetic fibers. This is related to the origin of natural cellulose fibers which are formed as fibers from plants. Inavoidably naturals cellulose fibers and synthetic fibers are processed by entirely different techniques. Synthetic fibers such as acetic acid-containing cellulose fibers and rayon which are classified as cellulose fibers have the properties of being miscible or kneaded with solids and are distinct in this respect from the natural cellulose fibers of the present invention.

So far unknown is a technique for providing a deodorizing article of natural cellulose fibers which is excellent for use, more specifically, a natural cellulose fiber article which, when treated with solids of a basic zinc compound, a polycarboxylic acid, etc. (with which natural cellulose fibers can not be kneaded), is capable of producing a synergistic effect of deodorizing any of acids and basic substances, and capable of exhibiting the effect for a prolonged period of time.

In the above situation, the present inventors conducted extensive research to develop articles of natural cellulose fibers which are excellent for use and which are capable of exhibiting outstanding deodorant properties for a long term, and found the following facts.

(1) An article of natural cellulose fibers can not be imparted the desired deodorizing effect by dipping or padding using a homogeneous solution containing a polycarboxylic acid and a basic zinc compound or other basic inorganic metal compound. This is presumably because the polycarboxylic acid is reacted with the metal compound in the homogeneous solution, giving a metal salt of polycarboxylic acid which can not improve the deodorizing effect.

(2) The deodorizing effect may be imparted to an article of natural cellulose fibers by dipping the article into a solution of a metal salt of polycarboxylic acid (first bath) and impregnating the treated article with a solution of a basic inorganic metal compound (second bath). However, the article of natural cellulose fibers treated by this method can retain the desired deodorizing function for a short time, but not for a prolonged period of time. This failure is presumably due to the following fact. While the method gave an article which can effectively maintain the basic inorganic metal compound, the article gradually releases the polycarboxylic acid when repeatedly washed until none remain on the fibers.

(3) The desired article of natural cellulose fibers can be obtained by a process essentially comprising insolubilizing the water-soluble inorganic metal compound incorporated in the cellulose fiber article and heating the polycarboxylic acid combined with the cellulose fiber article.

The present invention has been completed based on this novel finding.

An object of the invention is to provide an article of natural cellulose fibers having an inorganic metal compound incorporated therein and a polycarboxylic acid combined therewith.

Another object of the invention is to provide an article of natural cellulose fibers which is capable of exhibiting excellent deodorant properties for a long term even when repeatedly washed.

A further object of the invention is to provide a process for preparing said article of natural cellulose fibers.

Other objects and features of the invention will become apparent from the following description.

According to the invention, there is provided a yarn, cloth, woven fabric, knitted fabric or nonwoven fabric composed of natural cellulose fibers, each fiber having incorporated therein a water-insoluble inorganic metal compound, and each fiber having at least one cured polycarboxylic acid combined therewith, said polycarboxylic acid being selected from the group consisting of polycarboxylic acids and partial salts thereof.

The natural cellulose fiber article of the present invention is characterized in that the cellulose fiber has a water-insoluble inorganic metal compound incorporated therein and a cured polycarboxylic acid combined therewith. The present invention does not require any support medium such as resin or other chemical substance because the natural cellulose fiber has incorporated therein an insoluble metal compound as converted from a metal ion within the fiber and the polycarboxylic acid combined therewith is cured by heating. The cellulose fiber of the present invention is less likely to release the metal compound and polycarboxylic acid even when repeatedly washed. The metal compound is not merely deposited on the cellulose fiber but behaves as if enclosed in the noncrystalline structure of the fiber.

Examples of natural cellulose fibers for use in the present invention are cotton and hemp fibers. Such fibers may be in the form of a blend with polyester or other synthetic fibers.

The inorganic metal compound to be incorporated into cellulose fibers is not limited specifically insofar as it is insoluble in water. Examples of useful inorganic metal compounds are hydroxides of transition metals such, as copper, silver, zinc, titanium, zirconium, vanadium, molybdenum, tungsten, chromium, iron, cobalt, nickel, manganese, germanium and cerium, hydroxides of amphoteric metals such as aluminum, silicon, tin and antimony, hydroxides of magnesium, carbonates, phosphates, silicates, aluminates and zirconates of other metals than alkali metals, and so on. Among them, it is preferred to use zinc hydroxide, zinc carbonate, magnesium hydroxide and magnesium carbonate. At least one of these metal compounds is incorporated in the natural cellulose fiber. According to the invention, 0.01 to 10 wt. %, preferably 0.1 to 5 wt. %, of at least one of these metal compounds is incorporated in the cellulose fiber. Less than 0.01 wt. % of the metal compound used makes it difficult to obtain the desired deodorizing effect, whereas more than 10 wt. % used tends to impair the hand of cellulose fibers. Therefore the use of metal compound outside said quantity range is undesirable.

The cured polycarboxylic acid is present in the cellulose fiber as combined therewith. Useful polycarboxylic acids include a wide range of those known, such as oxalic acid, malonic acid, succinic acid, glutaric acid, adipic acid, suberic acid, azelaic acid, sebacic acid, branched fatty acids with the same number of carbon atoms as glutaric acid, adipic acid, suberic acid, azelaic acid or sebacic acid, maleic acid, fumaric acid, cyclohexanedicarboxylic acid, hexahydrophthalic acid, hexahydroisophthalic acid, hexahydroterephthalic acid, tetrahydrophthalic acid, nadic acid, tricarbaryl acid, aconitic acid, methylcyclohexenetricarboxylic acid butanetetracarboxylic, cyclopentanetetracarboxylic acid, tetrahydrofurantetracarboxylic acid, an ene adduct of methyltetrahydrophthalic acid with maleic acid, malic acid, tartaric acid, citric acid, trimellitic acid, pyromellitic acid, biphenyltetracarboxylic acid, benzophenonetetracarboxylic acid, diphenylsulfonetetracarboxylic acid, and partial salts thereof. The term "partial salt of polycarboxylic acid" used herein refers to a salt of thereof having at least one free carboxyl group remaining after the reaction of all carboxyl groups with a base. Examples of partial salts of polycarboxylic acid are a sodium salt, a potassium salt and an ammonium salt of polycarboxylic acid. Of these polycarboxylic acids, butanetetracarboxylic acid is preferred in view of deodorant properties and durability of deodorizing effect. At least one of these polycarboxylic acids is incorporated in natural cellulose fibers as combined therewith. According to the present invention, 0.1 to 50 wt. %, preferably 0.5 to 20 wt. %, of such polycarboxylic acid is combined with the cellulose fiber. Less than 0.1 wt. % of polycarboxylic acid used results in difficulty in obtaining the desired deodorizing effect, whereas more than 50 wt. % used tends to degrade the cellulose fibers. Thus the use of polycarboxylic acid outside said quantity range is undesirable.

The articles of natural cellulose fibers according to the present invention can be prepared by the following processes (1) to (3).

(1) A process comprising the steps of impregnating natural cellulose fibers with a treating solution (A) containing a water-soluble inorganic metal compound and a polycarboxylic acid, squeezing the fibers when required, heating the fibers and insolubilizing the water-soluble inorganic metal compound incorporated in the fibers, giving the article of natural cellulose fibers of the present invention.

(2) A process comprising the steps of impregnating natural cellulose fibers with a treating solution (B) containing a water-soluble inorganic metal compound, insolubilizing the water-soluble inorganic metal compound incorporated in the fibers, impregnating the treated fibers with a treating solution (C) containing a polycarboxylic acid, squeezing the fibers when required and heating the fibers, giving the article of natural cellulose fibers of the present invention.

(3) A process comprising the steps of impregnating natural cellulose fibers with the treating solution (C) containing a polycarboxylic acid, squeezing the fibers when required, heating the fibers, impregnating the treated fibers with the treating solution (B) containing a water-soluble inorganic metal compound and insolubilizing the water-soluble inorganic metal compound incorporated in the fibers, giving the article of natural cellulose fibers of the present invention.

First, the process (1) will be described below, Examples of the water-soluble inorganic metal compound present in the treating solution (A) are organic acid salts (such as acetic acid salt, formic acid salt, etc.), chlorides, bromides, iodides, sulfates or nitrates of zinc or magnesium. Of these compounds, zinc chloride is preferred because it can be easily incorporated into natural cellulose fibers and it provides the fiber with the contemplated excellent deodorizing function without forming a salt with the polycarboxylic acid in the treating solution (A). The treating solution (A) contains the water-soluble inorganic metal compound at a concentration of 0.1 to 60 wt. %, preferably 0.1 to 20 wt. % (based on the anhydride). When the metal compound is used at a concentration outside the above range, it is difficult to incorporate the contemplated amount of metal compound in the fiber. The concentration of the water-soluble inorganic metal compound is not limited specifically insofar as the compound is incorporated in the fiber in said concentration range after the series of treatment. The concentration of the metal compound can be suitably selected depending on the kind of a method of dipping the treating solution to be described later, squeezing ratio and other conditions.

The concentration of polycarboxylic acid in the treating solution (A) is 0.01 to 50 wt. %, preferably 0.1 to 20 wt. %. When the polycarboxylic acid is used at a concentration outside said range, it is difficult to combine the above specified amount of the acid with the cellulose fibers under commercial conditions. The concentration of polycarboxylic acid is not limited specifically, and the same can be said as concerning the concentration of inorganic metal compound.

The pH of the treating solution (A), although not limited specifically, is usually 1 to 6, preferably 2 to 5. In the case of pH in excess of 6, it is difficult for the cellulose fiber to deodorize ammonia, and the zinc compound recommended above is likely to separate out as insolubles in e bath. At a pH of less than 1, the cellulose fiber will become easily degraded. Thus, either case is undesirable.

Alkalis and salts which are usable in adjusting the pH of the treating solution (A) include, for example, sodium hydroxide, sodium bicarbonate, sodium carbonate sodium borate, sodium metaborate, sodium silicate, sodium, metasilicate, sodium phosphate, sodium metaphosphate, sodium polyphosphate, sodium pyrophosphate, sodium phosphite, sodium hypophosphite, sodium formate, sodium acetate, etc. Usable instead of sodium are potassium, ammonium, salts of methylamine, dimethylamine, trimethylamine, triethylamine and other volatile lower amines, etc. These pH adjusting agents can be used singly or at least two of them are usable. The amount of the pH adjusting agent is 0.1 to 10 wt. % although variable with the dissolution amount or kind of alkalis, salts, polyphosphoric acid, etc.

The natural cellulose fiber articles can be impregnated with the treating solution (A) by various conventional methods, for example, by dipping, padding, spraying or coating. The dipping or padding method is suitable to practice.

More specifically, the dipping method is conducted by dipping the fiber article in the treating solution (A) and treating the article at room temperature to 100° C. for 1 second to 10 minutes. The treatment conditions differ with the kind of fiber and the fiber is treated under conditions optimum for the fiber to be treated are used. After dipping treatment, the fiber is heat-treated. In practicing the present invention, it is preferred to dry the treated article before heat treatment.

The padding method is especially suited to woven fabrics and knitted fabrics. Stated more specifically, when the padding method is resorted to, the fiber is treated as immersed in the treating solution (A) at room temperature to 100° C. for 1 second to 10 minutes and is thereafter squeezed as by a mangle to a predetermined uniform ratio. This treatment is conducted under conditions optimum for the fiber and suitably selected. Subsequently the fiber is heat-treated. Alternatively the fiber may be dried prior to heat treatment in praticing the present invention. In the padding method, drying prior to heat treatment is desirable as in the dipping method.

The subsequent heat treatment is conducted by heating the natural cellulose fiber article having impregnated therein the water-soluble inorganic metal compound and polycarboxylic acid. The heating temperature, although not limited specifically, is usually 80° to 250° C., preferably 120° to 210° C. When heated at a higher temperature, the cellulose fiber tends to diminish the strength and to yellow, whereas the fiber, when heated at a lower temperature, tends to easily impair the deodorant properties when washed with water. The heating time is 5 seconds to 60 minutes, preferably 15 seconds to 5 minutes.

In the process (1), subsequently, the water-soluble inorganic metal compound incorporated in the natural cellulose fiber is insolubilized. The insolubilization is performed, for example, by converting the water-soluble inorganic metal compound incorporated in the cellulose fiber into a water-insoluble inorganic metal compound using an aqueous solution of an alkaline inorganic compound. Useful alkaline inorganic compounds include a wide range of conventional compounds such as alkali metal salts, alkaline earth metal salts, hydroxides, carbonates, percarbonates, etc. of these inorganic compounds, sodium hydroxide, potassium hydroxide, sodium carbonate and potassium carbonate are preferred in view of improved efficiency and high productivity. Such alkaline inorganic compounds can be used singly or in mixture. The concentration of the alkaline inorganic compound in the aqueous solution, although not limited specifically, is usually 0.1 to 50 wt. %, preferably 0.5 to 20 wt. %. The alkaline inorganic compound used at a higher concentration, necessitates an excess degree of washing with water, tending to reduce the efficiency and thus the productivity, whereas the use at a lower concentration tends to make it difficult to insolubilize the water-soluble inorganic metal compound. The insolubilization can be carried out, for example, by dipping, padding, spraying or coating. The dipping or padding method is suitable to practice. The dipping method can be used to treat fibers in any form and s suitable to treat woven fabrics and knitted fabrics. Stated more specifically, when the padding method is resorted to, the fiber is treated as immersed in an aqueous solution of an alkaline inorganic compound at room temperature to 70° C. for 1 second to 5 minutes, and is thereafter squeezed as by a mangle to a predetermined uniform ratio. This treatment is conducted under conditions optimum for the fiber and suitably selected. The squeezing ratio to be actually used is about 40 to about 200%.

The padded and squeezed fiber is then soaped or washed with water to remove the alkaline inorganic compound, followed by drying, whereby the natural cellulose fiber of the invention is prepared.

Next, the process (2) will be described below. The concentration of the water-soluble inorganic metal compound in the treating solution (B) is as stated above in the description of the treating solution (A). The treating solution (B) can be incorporated in the cellulose fiber article by various conventional methods as by dipping, padding, spraying or coating. The dipping or padding method is suitable to practice. These methods can be performed as stated above in the description of the process (1). After dipping treatment, the water-soluble inorganic metal compound incorporated in the natural cellulose fiber is insolubilized. The insolubilizing treatment and after-treatment are done in the same manner as in the process. (1).

In the process (2), the treated cellulose fiber is dipped in the treating solution (C) containing a polycarboxylic acid and having a pH adjusted to the same level as in the treating solution (A). The concentration of the polycarboxylic acid in the treating solution (C) is as stated above in the description of the treating solution (A). The treating solution (C) can be incorporated into the cellulose fiber article by various conventional methods as by dipping, padding, spraying or coating. The dipping or padding method is suitable to practice These methods can be performed as stated above in the description of the process (1). The subsequent heat treatment is effected in the same manner as in the process (1).

The process (3) will be described below. The concentration of the polycarboxylic acid in the treating solution (C) is as stated above in the description of the treating solution (A). The treating solution (C) can be incorporated in the cellulose fiber article by the same dipping method as stated above for the process (2). The subsequent heat treatment is conducted in the same manner as in the process (1).

In the process (3), the above-treated natural cellulose fiber is dipped in the treating solution (B) containing a water-soluble inorganic metal compound after heat treatment. Then the water-soluble inorganic metal compound incorporated in the fiber is insolubilized. The concentration of the water-soluble inorganic metal compound in the treating solution (B) is the same as that of the water-soluble inorganic metal compound in the treating solution (A). The dipping method for the treating solution (B) is as stated above for the process (2). After dipping treatment, the water-soluble inorganic metal compound incorporated in the natural cellulose fiber is insolubilized. The insolubilizing treatment and after-treatment are done in the same manner as in the process (1).

According to the invention, an article of natural cellulose fibers can be prepared which exhibit improved deodorant properties and which is capable of retaining the function for a prolonged period of time. The natural cellulose fiber of the present invention has an insoluble inorganic metal compound incorporated therein and a cured polycarboxylic acid combined with the fiber so that the fiber is excellent in washing fastness, therefore less likely to release these components even if washed repeatedly and capable of retaining the function for a prolonged period of time. The natural cellulose fiber article of the invention is fully satisfactory also in hand.

The natural cellulose fiber article of the present invention can be treated, when required, for softening the article. For example, a fabric softening agent such as a polyethylene emulsion, dimethyl silicone and modified silicone for fabrics (such as aminosilicone, ether silicone, etc.) may be added to any of treating baths, whereby the article is imparted an improved hand.

Among the processes (1) to (3), the process (1) is superior in efficiency to the other processes because it involves a fewer steps, and the process (3) provides a natural cellulose fiber article which can constantly exhibit deodorant properties and which has a fiber strength reduced to a less extent by the treatment, as compared with the other processes.

The invention will be described in greater detail with reference to the following examples and comparative examples.

EXAMPLE 1

The natural cellulose fiber article of the invention was prepared according to the process (1). Stated more specifically, a cotton fabric weighing 120 g/m$^2$ and scoured, bleached and mercerized was subjected to padding process by being immersed in an aqueous solution containing 6.9 wt. % of 1,2,3,4-butanetetracarboxylic acid (hereinafter referred to as "BTC"), 1.2 wt. % of sodium carbonate and 1.2 wt. % of zinc chloride (first bath), squeezed with a mangle, dried at 60° C., and heated at 160° C. for 3 minutes. The fabric was subsequently dipped in an aqueous solution containing 1.0 wt. % of sodium hydroxide (second bath) for 3 seconds, squeezed with the mangle, washed with hot water at 60° C. and dried. The fabric was found to contain 4 g/kg of zinc hydroxide as determined by the atomic absorption method and 35 g/kg of BTC as determined by high performance liquid chromatography.

EXAMPLE 2

A cotton fabric was treated in the same manner as in Example 1 with the exception of using as a first bath an aqueous solution containing 0.45 wt. % of magnesium chloride hexahydrate in place of zinc chloride. On analysis, the fabric was found to contain 1 g/kg of magnesium hydroxide and 3 g/kg of BTC.

EXAMPLE 3

The natural cellulose fiber article of the present invention was prepared according to the process (2). Stated more specifically, a polyester/cotton blended yarn fabric weighing 150 g/m$^2$ was bleached in the usual manner, dyed, dipped in an aqueous solution containing 1.6 wt. % of zinc chloride (first bath) and squeezed with a mangle. Thereafter the fabric was dipped in an aqueous solution containing 1.0 wt. % of sodium hydroxide (second bath) for 3 seconds, squeezed with the mangle, dipped in an aqueous solution containing 6.9 wt. % of BTC and 1.2 wt. % of sodium carbonate (third bath) and squeezed with the mangle. The fabric was dried at 120° C. heated at 190° C. for 2 minutes, washed with hot water at 60° C. and dried. On analysis, the fabric was found to contain 3 g/kg of zinc hydroxide and 16 g/kg of BTC.

EXAMPLE 4

The natural cellulose fiber article of the present invention was prepared according to the process (3). Stated more specifically, the same cotton fabric as in Example 1 was subjected to padding process by being immersed in an aqueous solution containing 6.9 wt. % of BTC, 1.2 wt. % of sodium carbonate and 4.O wt. % of monosodium phosphate (first bath), squeezed with a mangle, dried at 60° C. and heated at 180° C. for 3 minutes. Subsequently, the fabric was dipped in an aqueous solution containing 5.0 wt. % of zinc chloride (second bath) for 3 seconds, dried, dipped in an aqueous solution containing 2.0 wt. % of sodium carbonate (third bath), squeezed with the mangle, washed with hot water at 60° C. and dried. On analysis, the fabric was found to contain 7 g/kg of zinc carbonate and and 35 g/kg of BTC.

EXAMPLE 5

The natural cellulose fiber article of the present invention was prepared according to the process (1). Stated more specifically a cotton knitted fabric scoured and bleached was subjected to padding process by being dipped in an aqueous solution containing 5.0 wt. %. of citric acid, 3.0 wt. % of sodium hypophosphite, and 1.2 wt. % of zinc chloride (first bath), squeezed with a mangle, dried at 60° C., and heated at 180° C. for 3 minutes. The fabric was subsequently dipped in an aqueous solution containing 1.0 wt. % of sodium carbonate (second bath) for 3 seconds, squeezed with the mangle, washed with hot water at 60° C. and dried. On analysis, the knitted fabric was found to contain 6 g/kg of zinc hydroxide and 40 g/kg of citric acid.

Comparative Example 1

The same cotton fabric as in Example 1 was treated in the same manner as in Example 1 except that the treating solutions were free from zinc chloride and BTC.

Comparative Example 2

The same cotton fabric as in Example 1 was treated in the same manner as in Example 1 except that the treating solutions were free from BTC. On analysis, the cotton fabric was found to contain 4 g/kg of zinc

Comparative Example 3

The same cotton fabric as in Example 1 was treated in the same manner as in Example 1 except that the treating solutions were free from zinc chloride. On analysis, the fabric was found to contain 38 g/kg of BTC.

Comparative Example 4

The same cotton fabric as in Example 1 was treated in the same manner as in Example 1 except that the heat treatment at 160° C. for 3 minutes was not conducted. On analysis, the fabric was found to contain 4 g/kg of zinc hydroxide and free of BTC.

Washing Conditions

The fabrics obtained in Examples 1 to 5, and those obtained in Comparative Examples 1 to 4 (LO) were washed in a household washing machine under the following conditions. For the sake of convenience, washing the fabric in water at ordinary temperature for 10 minutes using 2 g/liter of a household detergent (brand name: NEW BEADS, product of Kao Soap Co., Ltd.) was regarded as one washing cycle. The washing cycle was repeated 10 times, followed by rinsing with water, dewatering and drying to obtain 10-cycle washing (L-10).

Evaluation of Deodorizing Ability

1. Odor-releasing Compound Removal Efficiency

A sample of the fabric, 10 cm×10 cm, was placed into a 600-ml Erlenmeyer flask, which was then closed with a stopper. A gaseous or liquid compound releasing an offensive odor and having a specified concentration was then injected into the flask from its top using a microsyringe and allowed to stand for 60 minutes. The compound, when liquid, was evaporated by heating with a hot air gun and allowed to stand. The same gas or liquid was also injected into a flask containing no fabric sample and allowed to stand for 60 minutes. After standing, the gas concentration was measured using a Kitagawa gas sensor tube. Conditions for Injecting Odor-Releasing Compound Ammonia: A 20-ml quantity of 35% ammonia water was placed into a 100-ml Erlenmeyer flask and heated to produce ammonia gas. The gas was collected from an upper portion of the flask with a gastight syringe, and a 0.1-ml portion thereof was injected into the flask for use in the test.

Isovaleric acid: A 0.2-μl quantity of isovaleric acid was injected into the flask with a microsyringe and heated for evaporation.

The odor-releasing compound removal efficiency was calculated from the following equation.

$$\text{Removal efficiency (\%)} = \frac{A - B}{A} \times 100$$

wherein A is the gas concentration (ppm) in the flask containing no fabric, and B is the gas concentration (ppm) in the flask containing the fabric to be tested.

2. Organoleptic test A

An offensive odor-releasing compound was placed into the same Erlenmeyer flask as above containing a sample of each fabric (10-cycle washing), 10 cm×10 cm, and allowed to stand for 24 hours. Five panelists (adults) were made to smell the odor emitted from each sample. The degree of odor was evaluated according to the following 4-graded ratings, and an average of 5 panelists' results was calculated.

0: No odor was given off.
1: A slight odor was emitted.
2: An offensive odor was emitted.
3: A pronouncedly repulsive odor was diffused.

3. Organoleptic test B

Panelists for this test had feet which inherently gave out an offensive body odor. The panelists continuously wore the same socks for 3 days to obtain socks releasing an offensive odor. A sample of each fabric, 5 cm×5 cm, and a piece of said odor-releasing socks ere placed into the same Erlenmeyer flask as above which was then closed with a stopper, and were allowed to stand for 24 hours. The degree of odor was evaluated according to the same ratings as in organoleptic test A.

The fabrics of the examples and comparative examples and the untreated fabrics were tested for deodorizing ability before and after the washing, and the results are listed in Table 1.

TABLE 1

| | Ammonia | | | Isovaleric acid | | | | |
|---|---|---|---|---|---|---|---|---|
| | Removal efficiency (%) | | Organoleptic | Removal efficiency (%) | | Organoleptic | Organoleptic test B | |
| | L0 | L10 | test A | L0 | L10 | test A | L0 | L10 |
| Example 1 | 100 | 98 | 0 | 100 | 97 | 0 | 0 | 0 |
| Example 2 | 100 | 98 | 0 | 100 | 90 | 1 | 0 | 0 |
| Example 3 | 90 | 85 | 1 | 100 | 92 | 0 | 0 | 0 |
| Example 4 | 100 | 98 | 0 | 100 | 98 | 0 | 0 | 0 |
| Example 5 | 100 | 98 | 0 | 100 | 98 | 0 | 0 | 0 |
| Com. Ex. 1 | 75 | 72 | 3 | 60 | 65 | 3 | 3 | 3 |
| Com. Ex. 2 | 75 | 73 | 3 | 100 | 98 | 0 | 1 | 1 |
| Com. Ex. 3 | 100 | 98 | 0 | 60 | 72 | 2 | 2 | 2 |
| Com. Ex. 4 | 75 | 70 | 3 | 100 | 98 | 0 | 1 | 1 |

What we claim is:

1. A yarn, woven fabric, knitted fabric or nonwoven fabric composed of natural cellulose fibers, each fiber having incorporated therein a water-insoluble inorganic metal compound, and each fiber having at least one cured polycarboxylic acid combined therewith, said polycarboxylic acid being selected from the group consisting of polycarboxylic acids and partial salts thereof.

2. A yarn, woven fabric, knitted fabric or nonwoven fabric according to claim 1 wherein the natural cellulose fibers comprise cotton or hemp fibers or a blend of any of these fibers with synthetic fibers.

3. A yarn, woven fabric, knitted fabric or nonwoven fabric according to claim 1 or 2 wherein the water-insoluble inorganic metal compound comprises at least one compound selected from the group consisting of hydroxides, carbonates, phosphates, silicates, aluminates and zirconates of metals selected from copper, silver, zinc, zirconium, iron, cobalt, nickel, manganese, cerium, magnesium, calcium, strontium, barium, tin and antimony.

4. A yarn, woven fabric, knitted fabric or nonwoven fabric according to claim 1 or 2 wherein the water-insoluble inorganic metal compound comprises at least one compound selected from the group consisting of zinc hydroxide, zinc carbonate, magnesium hydroxide and magnesium carbonate.

5. A yarn, woven fabric, knitted fabric or nonwoven fabric according to claim 1 or 2 wherein the polycarboxylic acid comprises at least one compound selected from the group consisting of oxalic acid, malonic acid, succinic acid, glutaric acid, adipic acid, suberic acid, azelaic acid, sebacic acid, branched fatty acids with the same number of carbon atoms as glutaric acid, adipic acid, suberic acid, azelaic acid or sebacic acid, maleic acid, fumaric acid, cyclohexanedicarboxylic acid, hexahydrophthalic acid, hexahydroisophthalic acid, hexahydroterephthalic acid, tetrahydrophthalic acid, nadic acid, tricarbaryl acid, aconitic acid, methylcyclohexenetricarboxylic acid, butanetetracarboxylic acid, cyclopentanetetracarboxylic acid, tetrahydrofurantetracarboxylic acid, an ene adduct of methyltetrahydrophthalic acid with maleic acid, malic acid, tartaric acid, citric acid, trimellitic acid, pyromellitic acid, biphenyltetracarboxylic acid, benzophenonetetracarboxylic acid and diphenylsulfonetetracarboxylic acid.

6. A yarn, woven fabric, knitted fabric or nonwoven fabric according to claim 1 or 2 wherein the polycarboxylic acid is comprises butanetetracarboxylic acid.

7. A yarn, woven fabric, knitted fabric or nonwoven fabric according to claim 1 or 2 wherein the partial salt of polycarboxylic acid comprises a sodium salt, potassium salt or ammonium salt of polycarboxylic acid.

8. A yarn, woven fabric, knitted fabric or nonwoven fabric according to claim 1 or 2 which is composed of natural cellulose fibers having 0.01 to 10 wt. % of the water-insoluble inorganic metal compound incorporated therein and 0.1 to 50 wt. % of the polycarboxylic acid combined therewith.

9. A yarn, woven fabric, knitted fabric or nonwoven fabric according to claim 1 or 2 which is composed of natural cellulose fibers having 0.1 to 5 wt. % of the water-insoluble inorganic metal compound incorporated therein and 0.5 to 20 wt. % of the polycarboxylic acid combined therewith.

10. A process for preparing a yarn, woven fabric, knitted fabric or nonwoven fabric composed of natural cellulose fibers, each fiber having incorporated therein a water-insoluble inorganic metal compound, and each fiber having at least one cured polycarboxylic acid combined therewith, said polycarboxylic acid being selected from the group consisting of polycarboxylic acids and partial salts thereof, the process comprising the steps of impregnating natural cellulose fibers with a treating solution (A) containing a water-soluble inorganic metal compound and a polycarboxylic acid, heating the fibers and insolubilizing the water-soluble inorganic metal compound incorporated in the fibers.

11. A process for preparing a yarn, woven fabric, knitted fabric or nonwoven fabric composed of natural cellulose fibers, each fiber having incorporated therein a water-insoluble inorganic metal compound, and each fiber having at least one cured polycarboxylic acid combined therewith, said polycarboxylic acid being selected from the group consisting of polycarboxylic acids and partial salts thereof the process comprising the steps of impregnating natural cellulose fibers with a treating solution (B) containing a water-soluble inorganic metal compound, insolubilizing the water-soluble inorganic metal compound incorporated in the fibers, impregnating the treated fibers with a treating solution (C) containing a polycarboxylic acid, and heating the fibers.

12. A process for preparing a yarn, woven fabric, knitted fabric or nonwoven fabric composed of natural cellulose fibers, each fiber having incorporated therein a water-insoluble inorganic metal compound, and each fiber having at least one cured polycarboxylic acid combined therewith, said polycarboxylic acid being selected from the group consisting of polycarboxylic acids and partial salts thereof the process comprising the steps of impregnating natural cellulose fibers with a treating solution (C) containing a polycarboxylic acid, heating the fibers, impregnating the treated fibers with a treating solution (B) containing a water-soluble inorganic metal compound and insolubilizing the water-soluble inorganic metal compound incorporated in the fibers.

13. A process according to any one of claims 10 to 12 wherein the water-soluble inorganic metal compound comprises a compound selected from the group consisting of organic acid salts, chlorides, bromides, iodides, sulfates and nitrates of zinc or magnesium.

14. A process according to any one of claims 10 to 12 wherein the water-soluble inorganic metal compound comprises zinc chloride.

15. A process according to any one of claims 10 to 12 wherein the water-soluble inorganic metal compound comprises zinc chloride and the polycarboxylic acid comprises butanetetracarboxylic acid.

16. A process according to any one of claims 10 to 12 wherein the concentration of the water-soluble inorganic metal compound in treating solution (A) or (B) is 0.1 to 60 wt. %, based on the anhydride.

17. A process according to any one of claims 10 to 12 wherein the concentration of the water-soluble inorganic metal compound in treating solution (A) or (B) is 0.1 to 20 wt. %, based on the anhydride.

18. A process according to any one of claims 10 to 12 wherein the concentration of the polycarboxylic acid in treating solution (A) or (C) is 0.01 to 50 wt. %.

19. A process according to any one of claims 10 to 12 wherein the concentration of the polycarboxylic acid in treating solution (A) or (C) is 0.1 to 20 wt. %.

20. A process according to claim 10 wherein treating solution (A) has a pH of 1 to 6.

21. A process according to claim 10 wherein treating solution (A) has a pH of 2 to 5.

22. A process according to any of claims 10 to 12, 20 or 21 wherein the heating temperature is 80° to 250° C.

23. A process according to any of claims 10 to 12, 20 or 21 wherein the heating temperature is 120° to 210° C.

24. A process according to any of claims 10 to 12, 20 or 21 wherein the water-soluble inorganic metal compound incorporated in the natural cellulose fiber is converted into a water-insoluble inorganic metal compound using an aqueous solution of an alkaline inorganic compound.

25. A process according to claim 24 wherein the alkaline inorganic compound comprises at least one compound selected from the group consisting of alkali metal salts, alkaline earth metal salts, hydroxides, carbonates and percarbonates.

26. A process according to claim 24 wherein the alkaline inorganic compound comprises at least one compound selected from the group consisting of sodium hydroxide, potassium hydroxide, sodium carbonate and potassium carbonate.

27. A process according to claim 24 wherein the concentration of the alkaline inorganic compound is 0.1 to 50 wt. %.

28. A process according to any one of claims 10–12 wherein the process further comprises squeezing the fiber after each step of impregnating the fibers and before the step of heating the fibers.

* * * * *